US005542191A

United States Patent [19]

Shouse et al.

[11] Patent Number: 5,542,191

[45] Date of Patent: Aug. 6, 1996

[54] FOOTWEAR DRYING INSERT

[75] Inventors: Elizabeth J. Shouse; Ronald W. Shouse, both of Overland Park, Kans.

[73] Assignee: Shouse Financial Corporation, Kansas City, Mo.

[21] Appl. No.: 548,280

[22] Filed: Oct. 25, 1995

[51] Int. Cl.[6] ..... F26B 25/00

[52] U.S. Cl. ..... 34/104; 36/10; 36/55; 34/80; 34/81; 34/202

[58] Field of Search ..... 34/80, 81, 104, 34/202, 472; 36/43, 10, 55, 98, 114

[56] References Cited

U.S. PATENT DOCUMENTS

| | | | |
|---|---|---|---|
| 2,038,071 | 4/1936 | Wilhelm . | |
| 2,173,528 | 9/1939 | Beale . | |
| 2,349,856 | 5/1944 | Feldman . | |
| 2,435,131 | 1/1948 | Desbiens | 36/3 |
| 2,446,361 | 8/1948 | Clibbon . | |
| 2,671,277 | 3/1954 | Montgomery . | |
| 2,710,905 | 6/1955 | Schramm . | |
| 2,713,214 | 7/1955 | Gulaskie . | |
| 2,869,253 | 1/1959 | Sachs | 36/3 |
| 2,994,404 | 8/1961 | Schifferly . | |
| 3,028,897 | 4/1962 | Gooding . | |
| 3,131,036 | 4/1964 | Hirschberg . | |
| 3,392,511 | 7/1968 | King, Jr. . | |
| 3,417,482 | 12/1968 | Peet . | |
| 3,694,940 | 10/1972 | Stohr | 36/10 |
| 4,124,116 | 11/1978 | McCabe, Jr. . | |
| 4,294,405 | 10/1981 | Ross . | |
| 4,394,144 | 7/1983 | Aoki . | |
| 4,400,840 | 8/1983 | Sly . | |
| 4,420,893 | 12/1983 | Stephan | 36/3 |
| 4,428,484 | 1/1984 | Rattay et al. . | |
| 4,433,783 | 2/1984 | Dickinson . | |
| 4,497,080 | 2/1985 | Inspector . | |
| 4,724,627 | 2/1988 | Sisco | 36/119 |
| 4,749,392 | 6/1988 | Aoki et al. . | |
| 4,768,293 | 9/1988 | Kaffka . | |
| 4,845,862 | 7/1989 | Phillips, Jr. et al. | 36/83 |
| 4,901,450 | 2/1990 | Chemello et al. | 36/10 |
| 4,991,317 | 2/1991 | Lakic | 36/44 |
| 5,003,707 | 4/1991 | Chu . | |
| 5,009,308 | 4/1991 | Cullen et al. . | |
| 5,025,575 | 5/1991 | Lakic | 36/44 |
| 5,037,459 | 8/1991 | Spruill et al. . | |
| 5,137,154 | 8/1992 | Cohen . | |
| 5,172,495 | 12/1992 | Fehlhaber et al. | 36/55 |
| 5,291,669 | 3/1994 | Khoury et al. . | |

*Primary Examiner*—Henry A. Bennett
*Assistant Examiner*—Dinnatia Doster
*Attorney, Agent, or Firm*—Hovey, Williams, Timmons & Collins

[57] ABSTRACT

A footwear drying insert includes an elongated foot-shaped body defining opposing toe and heel ends and including tubular inner and outer layers of material that are secured together to define an intermediate space between the layers and an interior space within the inner tubular layer. A plurality of baffles are formed between and connect the inner and outer layers of the body together. The baffles extend in a direction generally parallel to the longitudinal axis between the toe and heel ends of the body to divide the intermediate space into compartments. A desiccant composition is enveloped within at least one of the compartments, and structure is provided for exerting outward support on the body during use. The support structure is compressible to allow the insert to be deformed for insertion into and removal from the footwear.

9 Claims, 1 Drawing Sheet

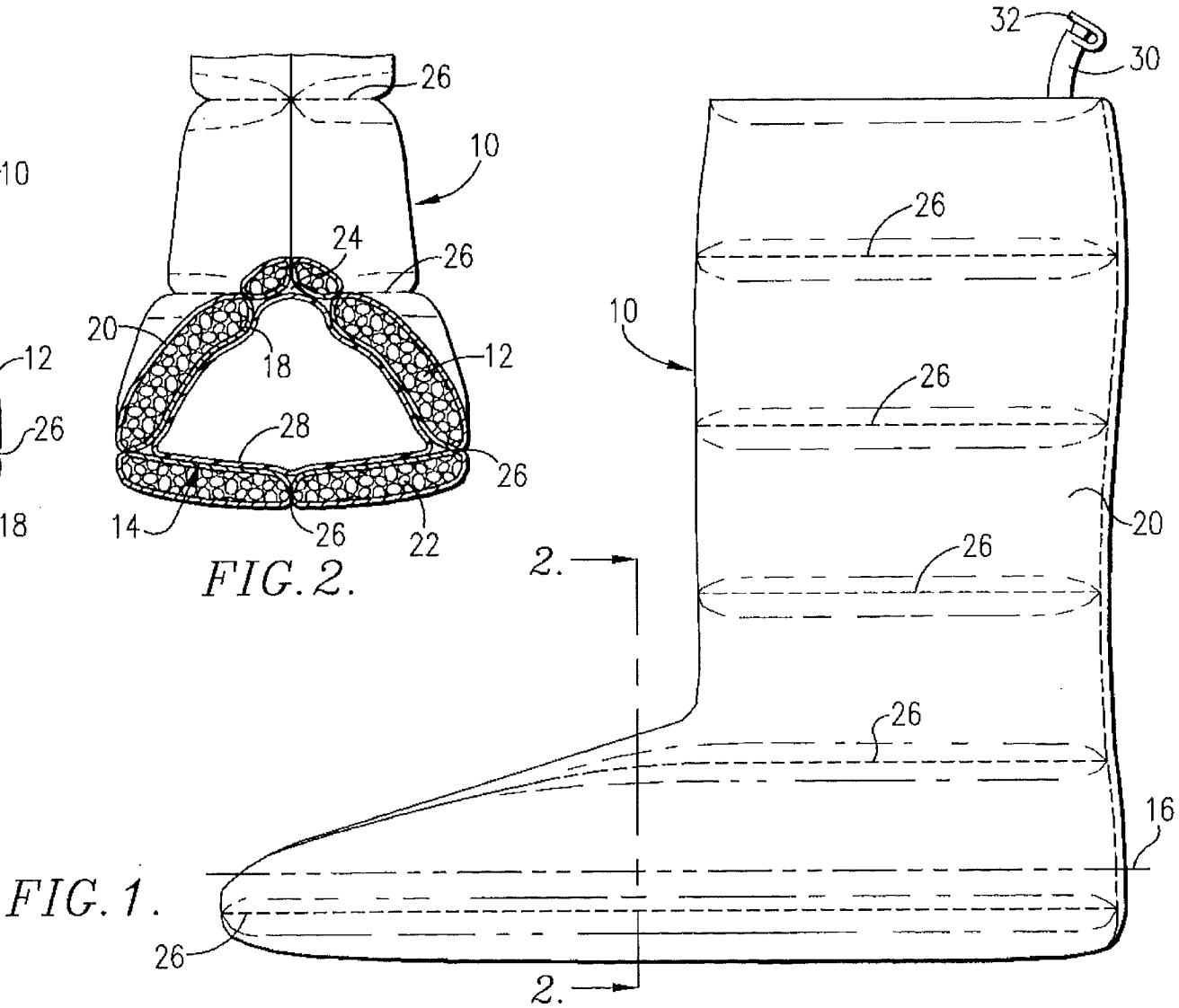
FIG. 1.
FIG. 2.
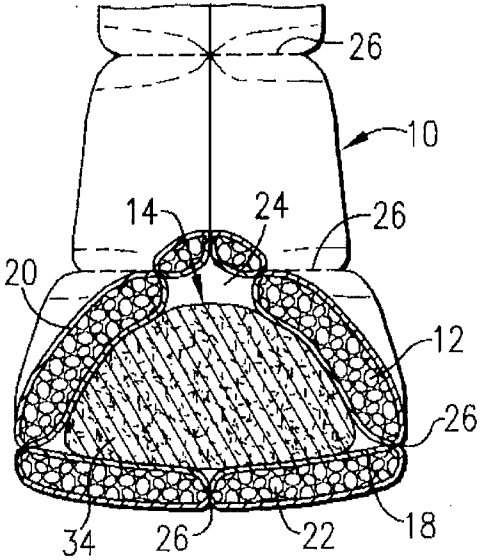
FIG. 3.

FOOTWEAR DRYING INSERT

BACKGROUND OF THE INVENTION

1. Field of the Invention

The present invention relates in general to apparatus for drying the interior of footwear. In particular, the present invention relates to an insert for placement within footwear, especially snow ski boots, which will capture moisture and thus dry the footwear.

2. Description of the Prior Art

The accumulation of moisture within the interior of footwear due to perspiration by the wearer has long been a problem. Certain types of footwear are also quite prone to accumulation of moisture in addition to that due to perspiration. For example, hiking boots may receive water from a lake or stream into their interior, and it is common for ski boots to accumulate moisture from melted snow. This moisture causes the wearer's feet to become excessively cold, promotes the growth and spread of bacteria harmful to humans and/or footwear, and reduces the wearer's comfort.

It is known to remove perspiration moisture during use of the shoe by employing an inner sole having a moisture removing agent, as exemplified in U.S. Pat. No. 2,713,214. However, while such inner soles are serviceable for drying some perspiration moisture, they do not provide sufficient moisture removal capabilities to maintain the user's feet dry upon ingress of additional moisture, as noted above. To eliminate such large amounts of moisture, it has been known to provide various devices for providing heat and/or an airstream to the interior of the footwear once the footwear has been removed from the user. Examples of such devices are shown in U.S. Pat. Nos. 2,710,905; 3,417,482; 4,768,293; and 5,003,707. Each of these devices suffers from the drawback that it requires electrical power for operation, and additionally is limited in effectiveness due to the difficulties in maintaining a proper flow of air within the closed cavity of the footwear or boot. They are also relatively expensive, relatively complicated, relatively heavy and relatively slow.

SUMMARY OF THE INVENTION

An object of the present invention is to provide a novel device which may remove large amounts of moisture from the interior of footwear while such footwear is not in use, with such drying being uniform throughout the article of footwear.

Another object of the present invention is to provide such a device which will make the footwear more comfortable to the wearer, last longer, and avoid promotion or growth of bacteria and the transmission of same in rental footwear.

Another object of the present invention is to provide such a device which does not require electrical power, and the complications associated therewith, and which is extremely safe to the user and to the article of footwear.

Another object of the present invention is to provide such a device which is of simple construction and use, and which is inexpensive.

Another object of the present invention is to provide such a device which is safe and easy to store, and will not be subject to mechanical or electrical failure.

Another object of the present invention is to provide such a device which is quiet, efficient and effective, drying the footwear in times comparable to, or faster than, prior art devices.

Another object of the present invention is to provide such a device which employs a desiccant composition, which composition will allow the device to be used, and possibly reused, many times.

Another object of the present invention is to provide such a device which will allow the moisture to enter the device, but will safely retain the desiccant composition therein, and which will not harm the article of footwear.

Another object of the present invention is to provide such a device which includes an indicator to allow the user to determine when the desiccant material has reached its absorption limit, and must be discarded or regenerated.

In accordance with these and other objects evident from the following description of a preferred embodiment of the invention, a footwear drying insert is provided which includes a foot-shaped body, a desiccant composition enveloped within the body, and a support means for providing outward support of the body during use. The body is elongated, defining opposing toe and heel ends and a longitudinal axis extending between the ends. The body includes tubular inner and outer layers of material that are secured together to define an intermediate space between the layers and an interior space within the inner tubular layer. A plurality of baffles are formed between and connect the inner and outer layers of the body together. The baffles extend in a direction generally parallel to the longitudinal axis between the toe and heel ends of the body to divide the intermediate space into compartments. The desiccant composition is preferably enveloped within at least one of the compartments, and the support means is provided in the interior space of the body. The support means is compressible to allow the insert to be deformed for insertion into and removal from the footwear.

By providing a construction in accordance with the present invention, numerous advantages are realized. For example, by providing a footwear drying insert having an elongated foot-shaped body including inner and outer tubular layers defining a compartmentalized intermediate space, it is possible to fill the intermediate space with a desiccant composition without the need for stuffing the entire body with such composition. In addition, by providing a support means for exerting outward support of the body during use, the desiccant material in the intermediate space is retained in close proximity to the interior surface of the footwear during use, facilitating drying of the footwear. By employing a support means that is compressible, insertion of the insert into and its removal from the footwear is facilitated.

Another advantage obtained from the use of the present invention results from employing a plurality of baffles between the inner and outer layers of body material such that the desiccant composition is supported within the compartments and is not allowed to clump or collect at one end or the other of the drying insert.

BRIEF DESCRIPTION OF THE DRAWING FIGURES

The invention is described in detail below with reference to the preferred embodiment illustrated in the attached drawing figures, wherein:

FIG. 1 is a side elevational view of a footwear drying insert constructed in accordance with the preferred embodiment;

FIG. 2 is a sectional view taken along line 2—2 of FIG. 1; and

FIG. 3 is a sectional view similar to FIG. 2, illustrating an alternate embodiment of the present invention.

DETAILED DESCRIPTION OF THE PREFERRED EMBODIMENT

A footwear drying insert constructed in accordance with the preferred embodiment is illustrated in FIG. 1, and is designed for use in removing moisture from an article of footwear such as a ski boot, hiking boot, ice or roller skate, or any other type of footwear that is exposed to moisture during use due to perspiration of the wearer or to ambient conditions. Such footwear typically includes a sole, an upper connected to the sole to define an interior space and an opening through which the wearer's foot is received. The interior space includes a forward toe portion, a heel portion behind the toe portion, and an ankle or shank portion extending upward from the heel portion. Where the footwear is of a high-top or boot variety, the opening is spaced further from the sole than is the case with a regular shoe or other low-top footwear.

With reference to FIG. 2, the insert generally includes a foot-shaped body 10, a desiccant composition 12 enveloped within the body, and a support means 14 for providing outward support of the body during use. Returning to FIG. 1, the body 10 is elongated, defining opposing toe and heel ends and a longitudinal axis 16 extending between the ends. As shown in FIG. 2, the body includes tubular inner and outer layers of material 18, 20 that are secured together to define an intermediate space 22 between the layers and an interior space 24 within the inner tubular layer 18. A plurality of baffles 26 are formed between and connect the inner and outer layers of the body together. The baffles extend in a direction generally parallel to the longitudinal axis 16 between the toe and heel ends of the body to divide the intermediate space 22 into compartments. The desiccant composition 12 is preferably enveloped within at least one of the compartments, and the support means 14 is provided in the interior space 24 of the body. The support means is compressible to allow the insert to be deformed for insertion into and removal from the footwear, and when properly positioned in the footwear, the insert substantially fills the interior space that would normally be occupied by the foot of a wearer.

The outer layer 20 of the body is preferably formed of a polyester fabric weighing 3.74 oz/yard and having 225 warp (long, strong thread) by 110 weft (salvage to salvage, short filler thread) strands/inch. The fabric is a twill weave of double strands, two over and two under, and is heat set to approximately 350° F. This preferred fabric is of a fine enough weave that it retains the desiccant composition within the insert regardless of whether the components of the desiccant composition are in granular or powder form. At the same time, the weave is coarse enough to allow the insert to breathe and to permit passage of moisture through the layer in both directions. Another desirable characteristic of the preferred material is that it be capable of withstanding temperatures in excess of about 212° F. such as may be experienced during regeneration of the insert, as described below. If a material other than the preferred material is to be used in the outer layer of the insert, it is necessary that the material at least have the physical characteristics noted herein such that the material retains the desiccant composition in the insert, allows the insert to breathe and permits water to pass in both directions through the layer, and is capable of withstanding elevated temperatures during regeneration.

Preferably, the outer layer is formed of two generally L-shaped panels, each of a shape corresponding to the desired overall shape of the insert. The panels are secured together along the entire perimeter of the panels to form a closed tube so that any movement of air or moisture into and out of the body occurs through the outer layer.

The inner layer 18 of the body is not necessarily formed of the same material as the outer layer 20. Although it is necessary for the material of the inner layer to withstand the same maximum regeneration temperatures as the outer layer, it is not essential that the material of the inner layer prevent the passage of powdered desiccant material from the intermediate space of the body into the interior space. Thus, any common natural or synthetic fiber, such as polyester fabric, having a suitably high melting point can be used to form the inner layer.

The inner layer is formed of two generally L-shaped panels, corresponding in shape to that of the panels used in the outer layer. The inner panels are secured together along the entire perimeter of the panels to form a closed tube so that the interior space defined by the inner layer is closed and is separated from the intermediate space defined between the inner and outer layers.

The baffles 26 are formed between and connect the inner and outer layers 18, 20 of the body together, and are preferably formed by sewing the material together along vertically spaced, horizontally extending lines that are parallel to the longitudinal axis 16 extending between the toe and heel ends of the body, as shown in FIG. 1. The thread used in forming the baffles is preferably a natural or synthetic thread having at least the same minimum heat-resistant characteristics as the material used in the inner and outer layers. The baffles divide the intermediate space 24 into elongated, horizontally extending compartments within which the desiccant composition is retained.

With reference to FIG. 2, the desiccant composition 12 generally includes a desiccant and one or more fillers. Although any known granular or powdered desiccant can be used in the insert, the preferred desiccant is silica gel, which is an amorphous form of silica manufactured from sodium silicate and sulfuric acid. The interconnected pores of silica gel form a vast surface area that will attract and hold water by adsorption and capillary condensation, allowing the silica gel to adsorb about 40% of its weight in water at room temperature. In addition, silica gel is non-corrosive and non-toxic, some grades having been approved by the U.S. government for use in food and drug packaging.

Although the compartments of the intermediate space 22 could be filled completely with silica gel or another desiccant, it is preferred to provide a composition including a filler that combines with the desiccant to fill the space, while reducing the weight of the insert. In addition, the filler is selected for its ability to dissipate heat during regeneration of the desiccant so that the insert can be easily and safely regenerated and repeatedly used to remove moisture from footwear. The preferred filler used in the composition is perlite, which is an amorphous siliceous aggregate that is lighter in weight than the selected desiccant, and that is non-hazardous. During regeneration, the filler dissipates heat from the desiccant to prevent overheating of the insert as moisture is released from the desiccant. Other fillers may be used in addition to the perlite in order to further enhance operation of the insert during use and regeneration.

Because the toe and heel of the insert are typically exposed to higher moisture levels than the ankle or shank, it is preferred that the desiccant composition used along the length of the insert include a higher percentage of desiccant than that used in the shank. For example, an exemplary embodiment of the insert includes a desiccant composition within the baffles running along the length of the foot including 34.8 volume percent silica gel, and a composition within baffles running along the shank including 9 volume percent silica gel. These different compositions are retained in the desired portions of the insert by the baffles which trap each composition within one of the horizontally extending compartments and prevent the composition from clumping at the bottom of the insert. Thus, although one composition is exposed to both the toe and heel of the insert, a different composition having less desiccant is retained in the shank compartments. If the desiccant composition employs too high a volume percentage of desiccant, it is possible that the insert would get too hot to handle during regeneration. On the other hand, if the desiccant composition employs too low a percentage of desiccant, the insert will not be effective in removing all of the moisture from a saturated article of footwear.

In the embodiment of FIGS. 1 and 2, the support means 14 includes a hollow bladder 28 formed of airtight material and a means for permitting air to be forced under pressure into the bladder. The bladder 28 is preferably formed of a shape corresponding to the shape of the body and is sized at least as large as the interior space so that when the bladder is inflated, the body expands to fill the interior space of the article of footwear within which the insert is positioned. The means for permitting air to be forced into the bladder preferably includes a tubular stem 30 protruding from the body and accessible to the user so that the user can fill the bladder by blowing into the stem. A cap 32 is provided for sealing the stem closed once air is forced into the bladder, maintaining the inflated, expanded condition of the insert during drying of the footwear. Alternately, a pump can be provided at a convenient location on the insert for pumping air under pressure into the bladder. Such a pump is conventionally used in tennis shoes, hiking boots and ski boots for improving the fit of such footwear, and includes a pair of one-way valves, each located at an opposite end of the pump for directing air in one direction through the pump between atmosphere and the bladder.

With reference to FIG. 3, an alternate embodiment of the support means 14 is illustrated, and includes a roll or wad of fill material 34 that provides outward support of the body during use. Preferably, an unbonded polyester fiber is used to form the fill along at least the foot portion of the insert, and a roll of bonded polyester batting fills the shank portion of the interior space. Both of these materials are compressible to allow the insert to be deformed so that the insert can be easily pushed into an article of footwear during use and removed from the footwear subsequent to drying. Regardless of the material selected for use in filling the interior space of the body, it must be capable of withstanding the same range of elevated temperatures as the inner and outer layers of the body, and should be pliant enough to enable the body to be deformed so that it can be pushed into and pulled from any article of footwear to be dried.

During construction, each outer panel is sewn to the adjacent inner panel along the baffles to form a panel assembly. Thereafter, the top, front and bottom edges of the two resulting panel assemblies are sewn together so that the compartments of the intermediate space, and the interior space of the body are only accessible from the rear edge of the body. This permits the compartments of the intermediate space to be filled with the desiccant composition and for the support means to be placed within the interior space of the body before the rear edge of the body is sewn shut. The resulting insert completely encloses the desiccant composition within the body between the inner and outer layers, and segregates the composition within the elongated, laterally extending compartments.

During use, the initially dry insert is deformed in order to permit its placement into a wet boot, shoe or other article of footwear to be dried. In the embodiment of FIGS. 1 and 2, this deformation is possible by deflating the bladder 28. Alternately, in the embodiment of FIG. 3, the deformation is possible due to the soft nature of the wad of fill 34. Thereafter, with the insert substantially filling the interior space, the footwear is sealed in an airtight bag or placed in a low humidity environment so that the desiccant retained in the insert adsorbs moisture from the article of footwear rather than from the surrounding air. Over the course of several minutes or hours, moisture is adsorbed into the desiccant from the boot, drying the footwear for subsequent use. Once a suitable amount of time has elapsed, the insert is withdrawn from the footwear, leaving only a very small percentage, if any, of the moisture in the footwear.

After one or more subsequent drying operations, the desiccant composition 12 nears a saturation point at which the composition is incapable of adsorbing additional moisture. In order to use the insert for further drying operations, it is necessary to regenerate the composition. The preferred method of achieving such regeneration is to heat the insert, reducing the capability of the desiccant to retain moisture and driving the moisture from the composition and from the insert. For example, by placing the insert in a microwave oven and activating the oven for a predetermined time, e.g. two or more three-to-six minute cycles between which the insert is turned, much of the moisture within the composition passes out of the desiccant and through the outer layer 20 of the body. Thus, the desiccant composition is dried so that the insert can be used subsequently in drying further articles of footwear.

Although the present invention has been described with reference to the preferred embodiment illustrated in the attached drawing figures, it is noted that substitutions may be made and equivalents employed herein without departing from the scope of the invention as recited in the claims. For example, a humidity indicator may be employed to signal the user that the desiccant composition has reached its moisture retaining limit. The indicator may take the form of a patch of commercially available moisture indicating material (e.g. that changes color above a predetermined humidity level) placed upon the exterior of the outer layer. However, other known types of indicator could also be used.

What is claimed is:

1. A footwear drying insert comprising:

an elongated foot-shaped body defining opposing toe and heel ends and a longitudinal axis extending between the ends, the body including tubular inner and outer layers of material that are secured together to define an intermediate space between the layers and an interior space within the inner tubular layer;

a plurality of baffles formed between and connecting the inner and outer layers of the body together, the baffles extending in a direction generally parallel to the longitudinal axis between the toe and heel ends of the body to divide the intermediate space into compartments;

at least one desiccant composition enveloped within at least one of the compartments; and a support means provided in the interior space for providing outward support of the body during use drying footwear, the support means being compressible to allow the insert to be deformed for insertion into and removal from the footwear.

2. A footwear drying insert comprising:

an elongated foot-shaped body defining opposing toe and heel ends and a longitudinal axis extending between the ends, the body including tubular inner and outer layers of material that are secured together to define an intermediate space between the layers and an interior space within the inner tubular layer;

a plurality of baffles formed between and connecting the inner and outer layers of the body together, the baffles extending in a direction generally parallel to the longitudinal axis between the toe and heel ends of the body to divide the intermediate space into compartments;

at least one desiccant composition enveloped within at least one of the compartments; and a support means provided in the interior space for providing outward support of the body during use drying footwear, the support means being compressible to allow the insert to be deformed for insertion into and removal from the footwear, the support means and the inner and outer layers of the body being formed of materials that are capable of withstanding elevated temperatures in excess of about 212° F.

3. A footwear drying insert as recited in claim 1, wherein the outer layer of the body is formed of a polyester fabric having a weave that retains the desiccant composition within the body while allowing bidirectional passage of moisture through the layer.

4. A footwear drying insert as recited in claim 1, wherein the baffles are each spaced from adjacent baffles by at least one inch.

5. A footwear drying insert as recited in claim 4, wherein the baffles are each spaced from adjacent baffles by about two inches.

6. A footwear drying insert comprising:

an elongated foot-shaped body defining opposing toe and heel ends and a longitudinal axis extending between the ends, the body including a shank extending upward from the heel end in a direction generally transverse to the longitudinal axis, and tubular inner and outer layers of material that are secured together to define an intermediate space between the layers and an interior space within the inner tubular layer;

a plurality of baffles formed between and connecting the inner and outer layers of the body together, the baffles extending in a direction generally parallel to the longitudinal axis between the toe and heel ends of the body to divide the intermediate space into compartments;

two desiccant compositions enveloped within the compartments, one of the compositions including a relatively high desiccant volume percentage and being enveloped in the compartments extending between the toe and heel ends, and the other of the compositions including a relatively low desiccant volume percentage and being enveloped in the compartments of the shank; and a support means provided in the interior space for providing outward support of the body during use drying footwear, the support means being compressible to allow the insert to be deformed for insertion into and removal from the footwear.

7. A footwear drying insert as recited in claim 1, wherein the support means includes an inflatable bladder supported within the interior space of the body, and a means for inflating the bladder to provide outward support of the body during use and for deflating the bladder to allow the insert to be deformed for insertion into and removal from the footwear.

8. A footwear drying insert as recited in claim 1, wherein the support means includes a compressible support material retained in the interior space of the body.

9. A footwear drying insert comprising:

an elongated foot-shaped body defining opposing toe and heel ends and a longitudinal axis extending between the ends, the body including tubular inner and outer layers of material that are secured together to define an intermediate space between the layers and an interior space within the inner tubular layer, the outer tubular layer being formed of a heat resistent synthetic fabric that is both gas and liquid permeable in both directions;

a desiccant composition enveloped within the intermediate space and including a granular desiccant material and a filler; and a support means provided in the interior space for biasing the body radially outward from the longitudinal axis to support the body during use drying footwear, the support means being compressible to allow the insert to be deformed for insertion into and removal from the footwear.

* * * * *